US012129640B2

(12) United States Patent
Kasakawa et al.

(10) Patent No.: US 12,129,640 B2
(45) Date of Patent: Oct. 29, 2024

(54) CHEMICAL SOLUTION SUPPLY DEVICE

(71) Applicant: Kobayashi Pharmaceutical Co., Ltd., Osaka (JP)

(72) Inventors: Kaoru Kasakawa, Osaka (JP); Kouji Nakatani, Osaka (JP); Yuji Nakayama, Tokyo (JP); Dan Luo, Tokyo (JP)

(73) Assignee: Kobayashi Pharmaceutical Co., Ltd., Osaka (JP)

( * ) Notice: Subject to any disclaimer, the term of this patent is extended or adjusted under 35 U.S.C. 154(b) by 119 days.

(21) Appl. No.: 17/907,620

(22) PCT Filed: Feb. 10, 2021

(86) PCT No.: PCT/JP2021/004979
§ 371 (c)(1),
(2) Date: Sep. 28, 2022

(87) PCT Pub. No.: WO2021/199699
PCT Pub. Date: Oct. 7, 2021

(65) Prior Publication Data

US 2023/0135682 A1 May 4, 2023

(30) Foreign Application Priority Data

Mar. 31, 2020 (JP) ..... 2020-063826

(51) Int. Cl.
*E03D 9/03* (2006.01)
*E03D 9/02* (2006.01)

(52) U.S. Cl.
CPC ..... *E03D 9/038* (2013.01); *E03D 9/032* (2013.01); *E03D 2009/028* (2013.01)

(58) Field of Classification Search
CPC .... E03D 9/032; E03D 9/038; E03D 2009/028
(Continued)

(56) References Cited

U.S. PATENT DOCUMENTS 3,953,902 A * 5/1976 Taylor ..... E03D 9/038 222/400.7
5,457,822 A * 10/1995 Klammsteiner ..... E03D 9/005 4/231

(Continued)

FOREIGN PATENT DOCUMENTS

JP 58-080483 U1 5/1983
JP 61-207732 A 9/1986

(Continued)

OTHER PUBLICATIONS

Office Action received in counterpart Japanese Patent Application No. 2020-063826 mailed on Aug. 1, 2023.

(Continued)

*Primary Examiner* — Huyen D Le
(74) *Attorney, Agent, or Firm* — Knobbe, Martens, Olson & Bear, LLP

(57) ABSTRACT

Provided is a chemical solution supply device for which an installation location can be easily ensured, and which can stably supply a chemical solution. The chemical solution supply device includes: a container having an inner space in which a chemical solution to be supplied to a toilet bowl is accommodated; and a flexible tube that is in communication with the inner space and defines a passage for guiding the chemical solution to the inside of the toilet bowl, or to the inside of a water tank for supplying washing water to the inside of the toilet bowl.

12 Claims, 14 Drawing Sheets

(58) Field of Classification Search
USPC ..... 4/223
See application file for complete search history.

(56) References Cited

U.S. PATENT DOCUMENTS

| | | | | |
|---|---|---|---|---|
| 2008/0272200 | A1* | 11/2008 | Ordiway | E03D 9/032 239/223 |
| 2010/0071121 | A1* | 3/2010 | Kissner | A47K 13/302 4/223 |
| 2011/0088153 | A1* | 4/2011 | Richard | B05B 1/20 4/223 |
| 2019/0360186 | A1* | 11/2019 | Foss | E03D 9/032 |

FOREIGN PATENT DOCUMENTS

| | | | |
|---|---|---|---|
| JP | 2002-054210 | A | 2/2002 |
| JP | 2008-111296 | A | 5/2008 |
| JP | 2013-79496 | A | 5/2013 |
| JP | 2016-124596 | A | 7/2016 |
| JP | 2017-218234 | A | 12/2017 |

OTHER PUBLICATIONS

International Search Report in PCT/JP2021/004979 issued Apr. 20, 2021.
Written Opinion of the International Searching Authority in PCT/JP2021/004979 dated Apr. 20, 2021.

* cited by examiner

CHEMICAL SOLUTION SUPPLY DEVICE

TECHNICAL FIELD

The present invention relates to a chemical solution supply device for supplying a chemical solution to a toilet bowl.

BACKGROUND ART

Conventionally, a chemical solution supply device has been known which is installed in a water supply receiving tray for washing hands in the upper portion of a water storage tank of a toilet, and which supplies a chemical solution for cleaning, deodorization, and fragrance to the washing water in the water storage tank (e.g., see Patent Document 1). A discharging tool is also known which discharges a gel-like chemical solution and adheres it like a stamp on the inner surface of a toilet bowl (e.g., see Patent Documents 2 and 3).

CITATION LIST

Patent Literature

Patent Document 1: JP 2013-79496A
Patent Document 2: JP 2016-124596A
Patent Document 3: JP 2017-218234A

SUMMARY OF INVENTION

Technical Problem

A chemical solution supply device such as that of Patent Document 1 cannot be installed if there is no water supply receiving tray for hand washing. Also, even if there is a water supply receiving tray, the chemical solution supply device cannot be installed if, for example, an ornament is placed on the water supply receiving tray. On the other hand, if a discharging tool such as that of Patent Documents 2 and 3 is used, the amount of chemical solution that can be adhered to the inner surface of the toilet bowl with a single stamp is limited, and thus there is a risk that the chemical solution on the inner surface of the toilet bowl will be peeled off by flushing, and the chemical solution cannot be stably supplied.

An object of the present invention is to provide a chemical solution supply device for which an installation location can be easily ensured, and which can stably supply a chemical solution.

Solution to Problem

A chemical solution supply device according to a first aspect of the present invention includes: a container having an inner space in which a chemical solution to be supplied to a toilet bowl is accommodated; and a flexible tube that is in communication with the inner space and defines a passage for guiding the chemical solution sent out from the inner space to the inside of the toilet bowl, or to the inside of a water tank for supplying washing water to the inside of the toilet bowl.

A chemical solution supply device according to a second aspect of the present invention is the chemical solution supply device according to the first aspect, in which the tube is installed so as to be sandwiched between a first element and a second element. The first element is a tank body included in the water storage tank and the second element is a lid of the tank body included in the water storage tank, or the first element is a rim of the toilet bowl and the second element is a toilet seat attached to the toilet bowl.

A chemical solution supply device according to a third aspect of the present invention is the chemical solution supply device according to the second aspect, further including a spacer that is installed so as to be sandwiched between the first element and the second element to prevent blockage of the passage.

A chemical solution supply device according to a fourth aspect of the present invention is the chemical solution supply device according to the second aspect or the third aspect, in which the tube is partially rigid at a portion to be sandwiched between the first element and the second element, or the chemical solution supply device further comprises a rigid guard portion that is attached to the portion of the tube that is to be sandwiched between the first element and the second element.

A chemical solution supply device according to a fifth aspect of the present invention is the chemical solution supply device according to any one of the first to fourth aspects, further including a connecting member that allows the inner space and the passage to indirectly be in communication with each other by being connected to the container and the tube, receiving the chemical solution from the inner space, and supplying the chemical solution to the passage.

A chemical solution supply device according to a sixth aspect of the present invention is the chemical solution supply device according to the fifth aspect, in which the connecting member has a reservoir having a storage space for storing the chemical solution received from the inner space. The tube is connected to the reservoir such that the passage is in communication with the storage space, and the reservoir supplies the chemical solution stored in the storage space to the passage.

A chemical solution supply device according to a seventh aspect of the present invention is the chemical solution supply device according to any one of the first to sixth aspects, further including a support member for supporting the container such that the container is installed on a lid of a tank body included in the water storage tank, on a side of the water storage tank, or on a side of the toilet bowl.

Advantageous Effects of the Invention

According to the above aspect, a tube that is in communication with the container is used to supply the chemical solution contained in the container to the toilet bowl. Since this tube is flexible and can be deformed into various shapes, the chemical sent out from the inside of the container can be easily guided into the water storage tank or the toilet bowl regardless of where the container is installed. Accordingly, it is easy to ensure an installation location for the chemical solution supply device, and the chemical solution can be stably supplied.

DESCRIPTION OF EMBODIMENTS

Chemical solution supply devices according to several embodiments of the present invention will be described below with reference to the drawings.

1. First Embodiment

1-1. Overview of Chemical Solution Supply Device

Figure 1:
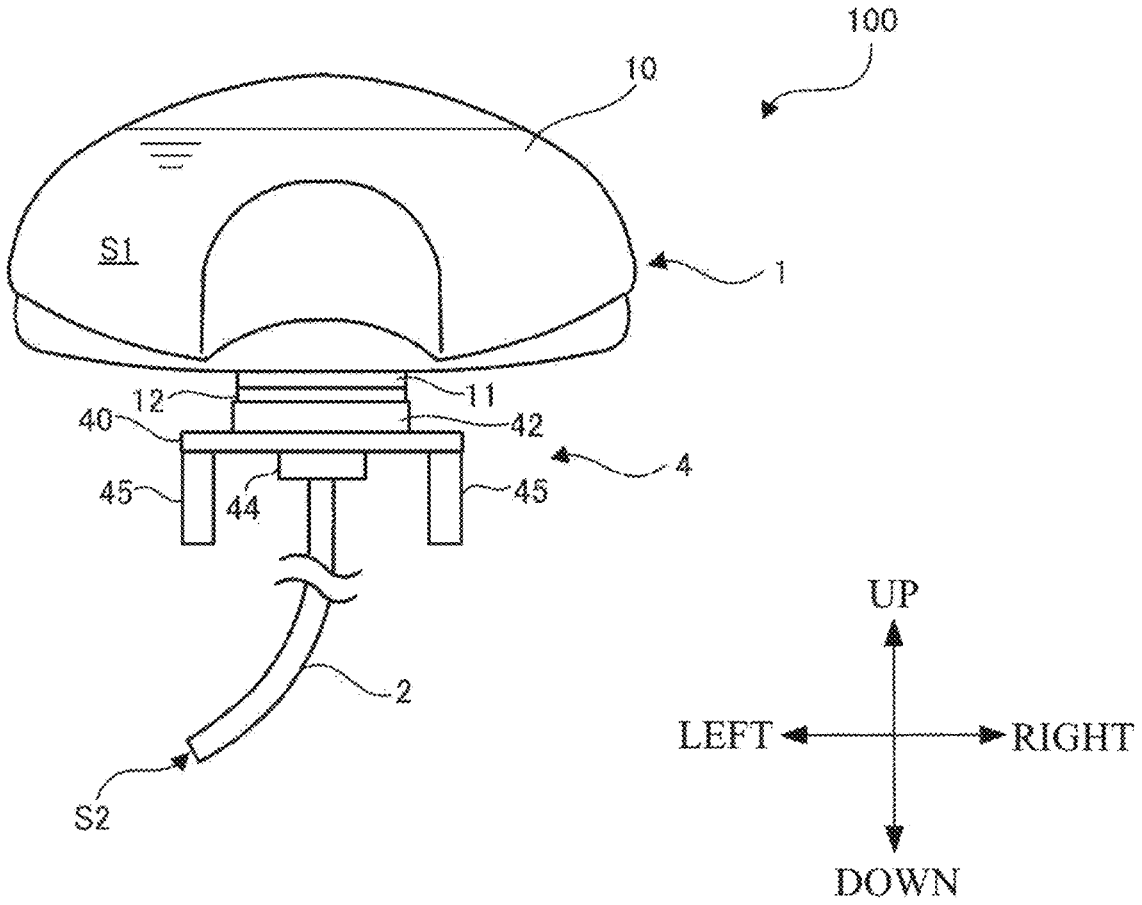
FIG. 1 is a front view of a chemical solution supply device according to a first embodiment of the present invention.
Figure 2:
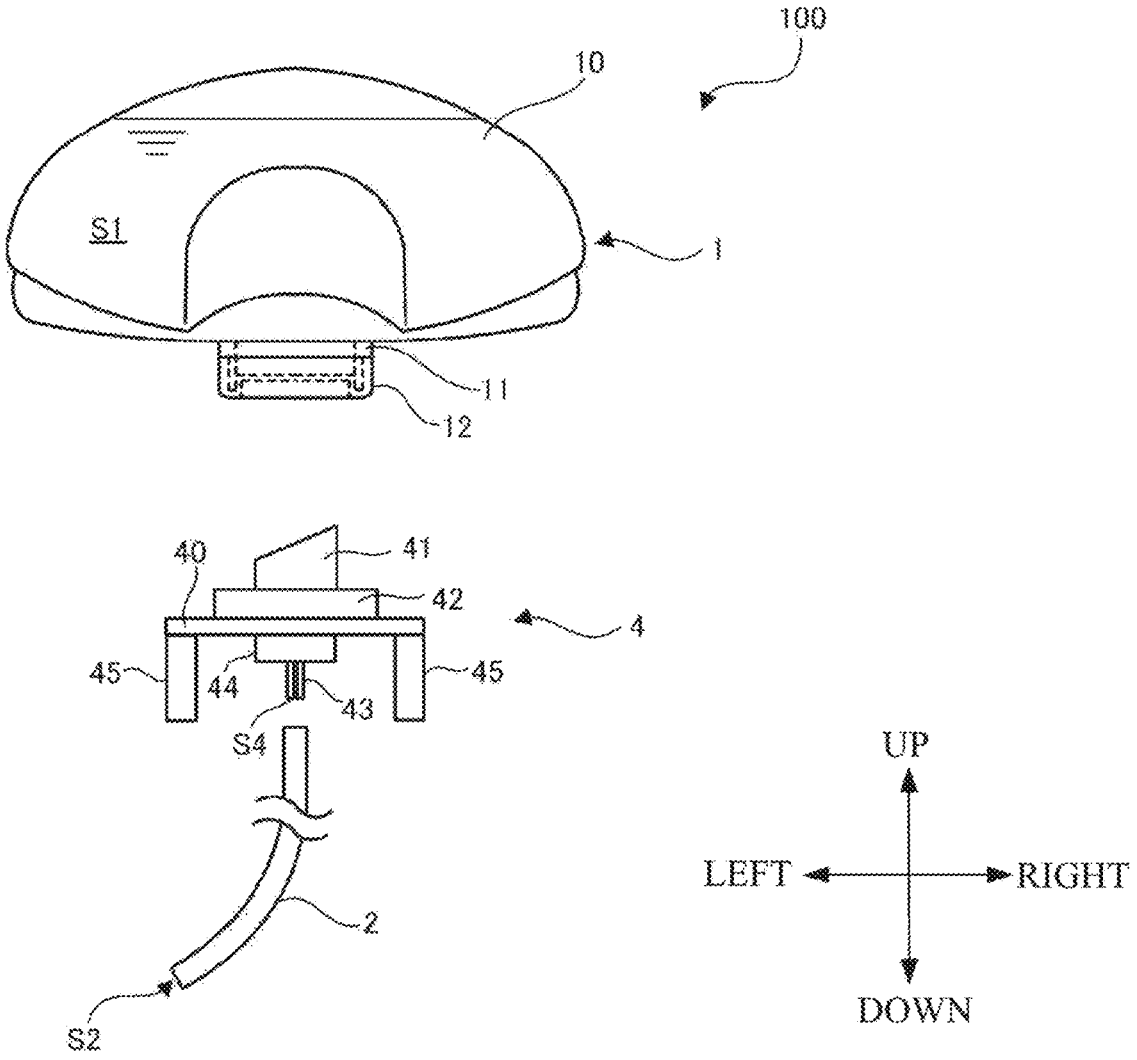
FIG. 2 is an exploded view of the chemical solution supply device according to the first embodiment.
Figure 3:
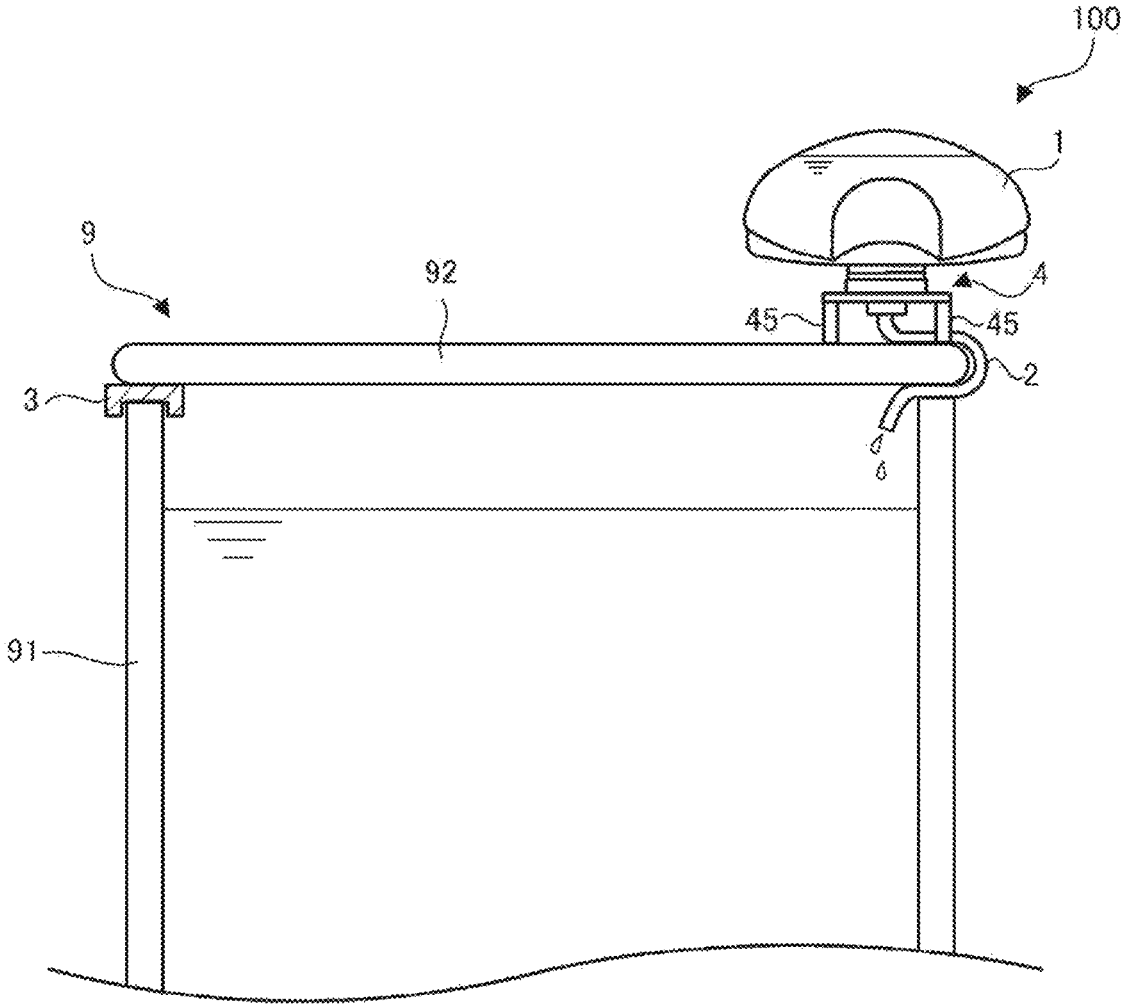
FIG. 3 is a diagram showing an installation example of the chemical solution supply device according to the first embodiment.

FIG. 1 is a front view of a chemical solution supply device 100 according to a first embodiment of the present invention, FIG. 2 is an exploded view thereof, and FIG. 3 is a diagram showing a typical installation example of the chemical solution supply device 100. The chemical solution supply device 100 is a device for supplying a chemical solution to the toilet bowl of a toilet, and as shown in these diagrams, the chemical solution supply device 100 includes a container 1 in which the chemical solution to be supplied to the toilet bowl is accommodated, and a tube 2 connected to the container 1. Note that in the description here, unless otherwise specified, "upper (top surface)", "lower (bottom surface)", "left", and "right" are defined as shown in FIGS. 1 and 2, and "front (front surface)" means the near side in FIGS. 1 and 2, and "rear (rear surface)" means the far side in FIGS. 1 and 2.

The chemical solution supply device 100 is installed in the surrounding area of the water storage tank 9 so that the chemical solution can be supplied into the water storage tank 9 that supplies washing water into the toilet bowl. The water storage tank 9 includes a tank body 91 with an opening at its upper portion, and a lid 92 covering the opening at the upper portion of the tank body 91. As shown in FIG. 3, the chemical solution supply device 100 is installed such that the container 1 is arranged on the upper surface of the lid 92 of the water storage tank 9 and the tube 2 is sandwiched between the tank body 91 and the lid 92. Note that the upper surface of the lid 92 here constitutes a substantially horizontal plane, and a water supply receiving tray for washing hands is not arranged on the upper surface of the lid 92.

The chemical solution supply device 100 of this embodiment further includes a spacer 3. The tube 2 defines, in its interior, a passage S2 that guides the chemical solution accommodated in the container 1 to the inside of the water storage tank 9. Similarly to the tube 2, the spacer 3 is installed so as to be sandwiched between the tank body 91 and the lid 92 in order to prevent the passage S2 of the chemical solution in the tube 2 from being clogged.

Also, the chemical solution supply device 100 of this embodiment further includes a connecting member 4 connected to the container 1 and the tube 2. The tube 2 is indirectly connected to the container 1 via the connecting member 4. Although the details will be described later, the connecting member 4 plays a role of controlling the amount of chemical solution supplied from the container 1.

The chemical solution contains one or more elements selected from the group including detergents, disinfectants, deodorants, and fragrances, and may also contain colorants. The chemical solution is mixed with the washing water to provide the effect of the components contained in the chemical solution to the inside of the toilet bowl or the inside of a toilet room. For example, if the chemical solution contains a detergent and a disinfectant, it can wash and disinfect the toilet bowl, and if it contains a deodorant and a fragrance, it can eliminate unpleasant odors in the toilet room and give off a pleasant scent.

1-2. Configuration of Each Portion

1-2-1. Container

As shown in FIGS. 1 to 3, the container 1 has a container body 10 having an inner space S1 in which a chemical solution is accommodated, and a cap 12 closing the inner space S1. The shape of the container body 10 is not particularly limited, but in the present embodiment, it has a dome shape that is wider in the left-right direction than in the depth direction and is slightly flattened in the left-right direction.

The container body 10 has an outlet portion 11 at the center of the lower portion thereof, which causes the inner space S1 and an outer space to be in communication with each other, and the outlet portion 11 has a cylindrical shape extending in the vertical direction. The cap 12 is fixed to the outlet portion 11 so as to cover and close the outlet portion 11. In FIG. 2, for reference, a cross section of the outlet portion 11 and the cap 12 taken along a plane that passes through the central axis of the outlet portion 11 and is parallel to the left-right direction is partially indicated by dotted lines.

The material constituting the container 1 is not particularly limited, but typically, hard resin or metal can be used thereas. For example, the container body 10 can be preferably made of synthetic resin such as polyethylene terephthalate, polyethylene, and polypropylene. The same applies to the cap 12 as well.

1-2-2. Connecting Member

FIGS. 4A to 4D are views of the connecting member 4 viewed from various directions. The connecting member 4 is arranged between the container 1 and the tube 2 to connect them.

Figure 4A:
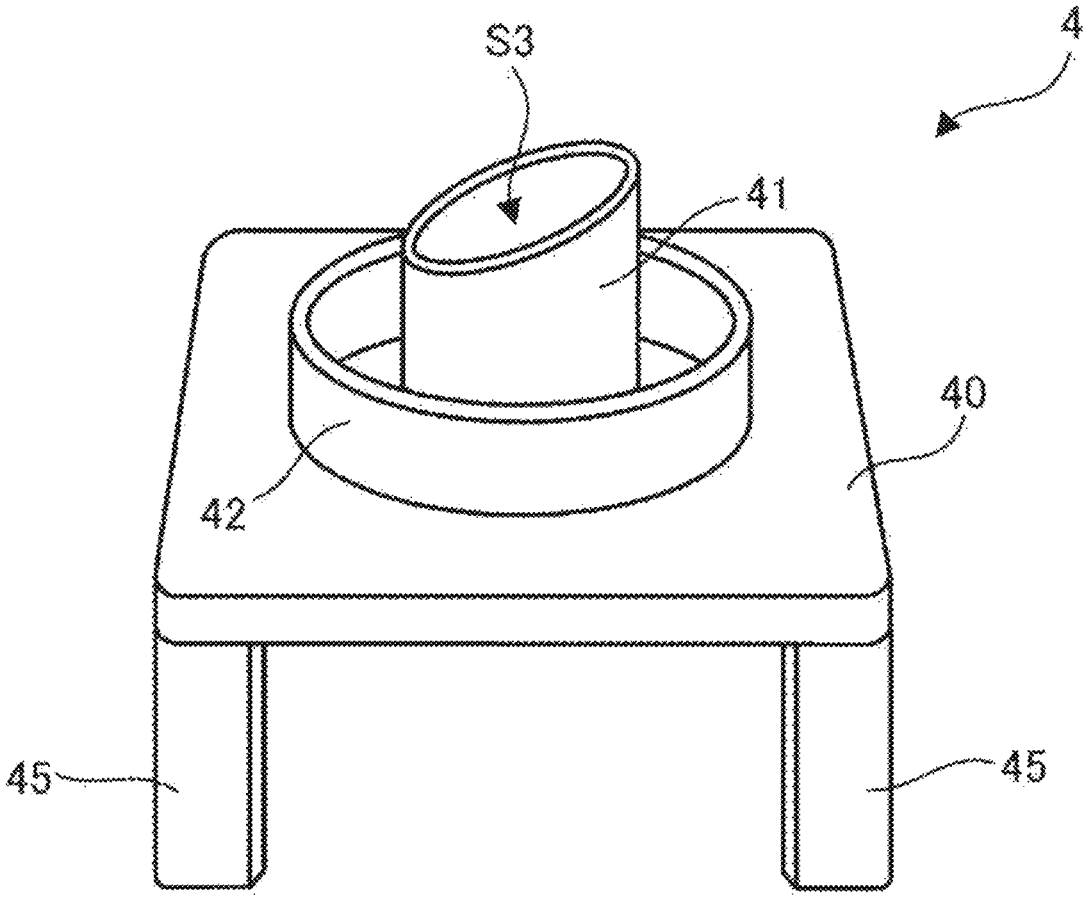
FIG. 4A is a perspective view of a connecting member according to the first embodiment, as viewed obliquely from above.
Figure 4B:
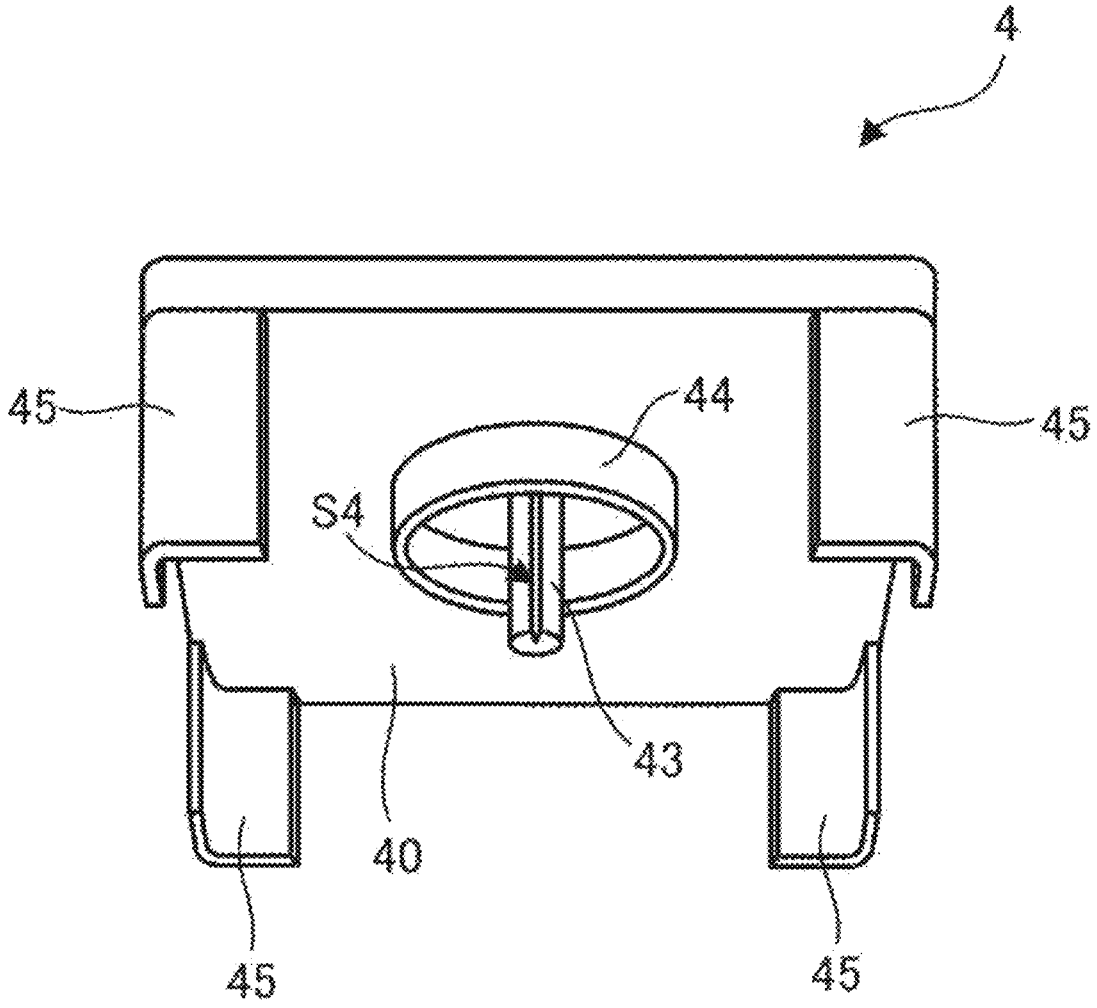
FIG. 4B is a perspective view of the connecting member according to the first embodiment, as viewed obliquely from below.
Figure 4C:
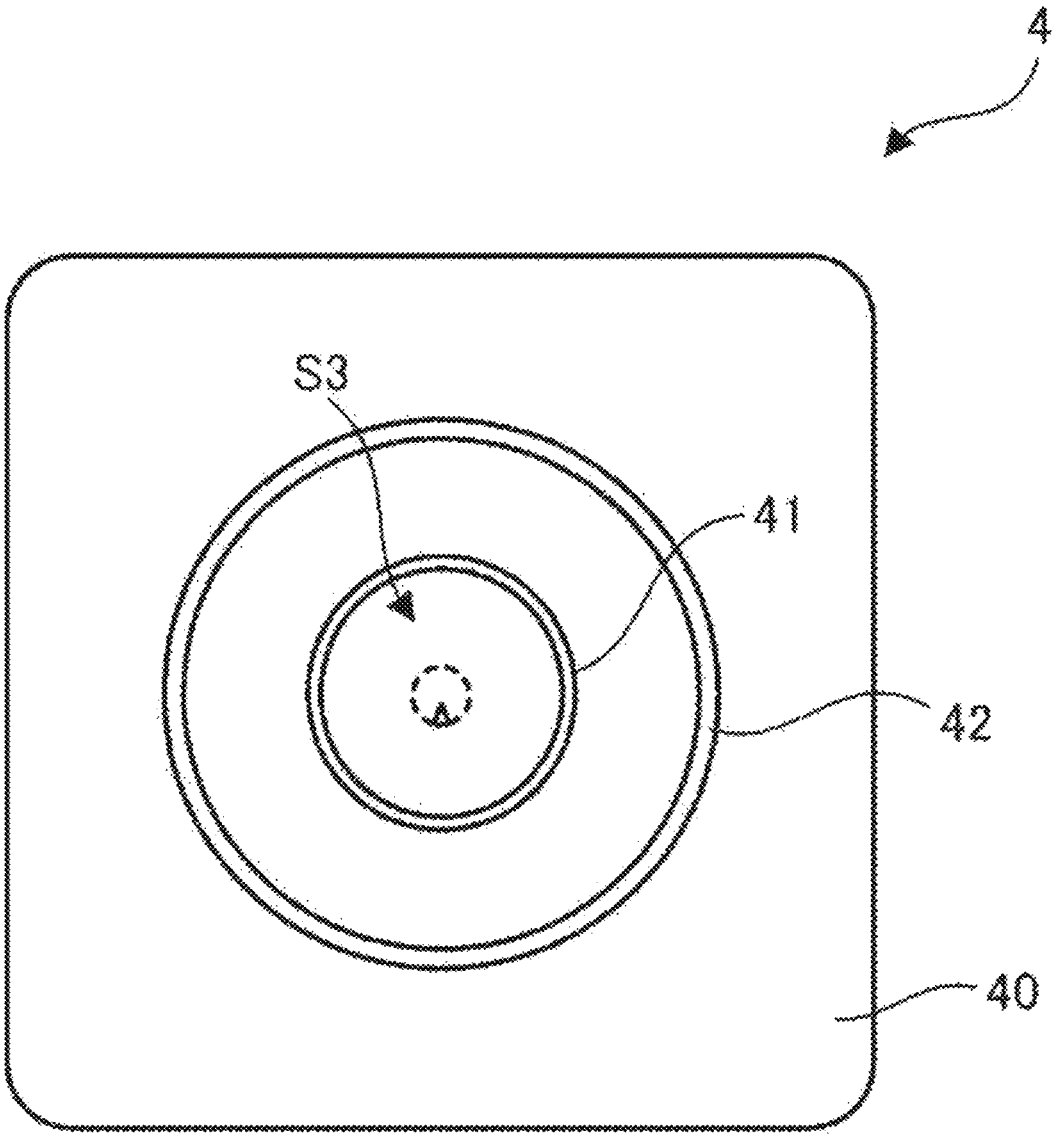
FIG. 4C is a plan view of the connecting member according to the first embodiment.

As shown in FIGS. 4A and 4C, the connecting member 4 has a rectangular plate-shaped base 40 and a cylindrical piercing portion 41 standing up from the center of the upper surface of the base 40. The piercing portion 41 has a shape obtained by obliquely cutting the upper portion of a cylinder extending in the vertical direction, and the upper portion thereof is sharp. The piercing portion 41 is inserted into the outlet portion 11 so as to pierce the bottom surface of the cap 12 of the container 1 from below. The connecting member 4 further has a cylindrical peripheral wall portion 42, and the peripheral wall portion 42 is spaced apart from the piercing portion 41 and stands up from the upper surface of the base 40 so as to surround the piercing portion 41. An annular space surrounded by the outer surface of the piercing portion 41 and the inner surface of the peripheral wall portion 42 receives the cap 12 and the outlet portion 11 of the container 1. At this time, the outer surface of the cap 12 and the inner surface of the peripheral wall portion 42 are in close contact with each other, and the connecting member 4 is fixed to the container 1 by the frictional force generated between them.

Figure 4D:
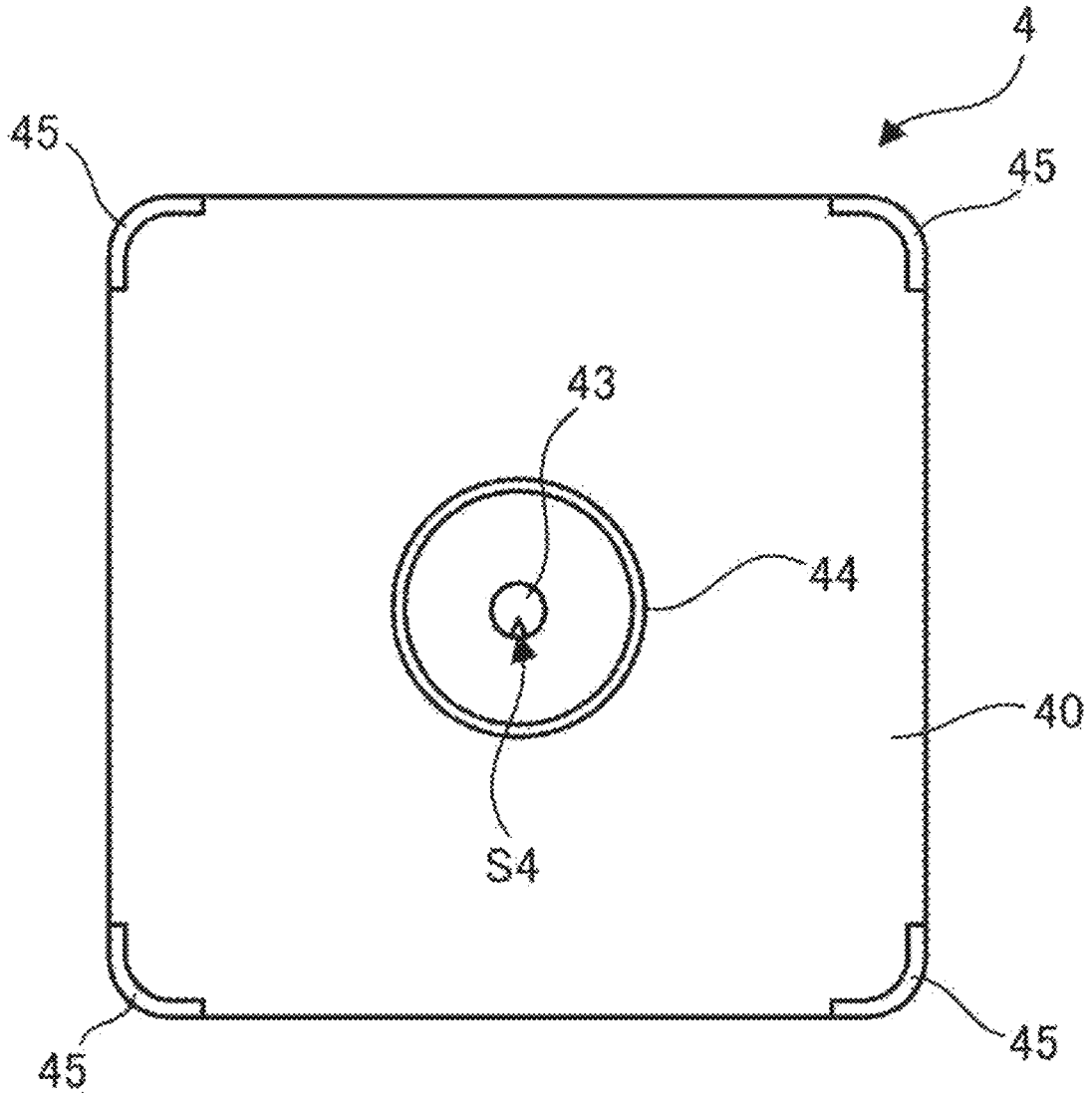
FIG. 4D is a bottom view of the connecting member according to the first embodiment.

Also, as shown in FIGS. 4B and 4D, the connecting member 4 further has an elongated columnar rod 43 hanging down from the center of the lower surface of the base 40. A fine groove S4 extending vertically over the entire length of the rod 43 is formed on the outer surface of the rod 43. The fine groove S4 extends so as to pass through not only the rod 43 but also the base 40, and is in communication with the space S3 inside the piercing portion 41. Accordingly, when the piercing portion 41 pierces the cap 12 and the container 1 and the connection member 4 are connected to each other, the fine groove S4 is in communication with the inner space S1 of the container 1 via the space S3 inside the piercing portion 41, and serves as a passage through which the chemical solution sent out from the inner space S1 flows. In this embodiment, the cross section of the fine groove S4 is V-shaped with a sharp bottom side.

The rod 43 is inserted into the passage S2 inside the tube 2 at one end of the tube 2. At this time, the inner surface of the tube 2 and the outer surface of the rod 43 are in close contact with each other, and the tube 2 is fixed to the connecting member 4 by the frictional force generated between them. As a result of the above, the fine groove S4 and the passage S2 are in communication with each other, and the chemical solution sent out from the inner space S1 is further sent to the passage S2 after passing through the fine groove S4. At this time, the chemical solution flows out from the inner space S1 to the fine groove S4 and further to the passage S2 at a slow speed due to capillary action as well as gravity.

The connecting member 4 further has a cylindrical peripheral wall portion 44, and the peripheral wall portion 44 hangs down from the lower surface of the base 40 so as to surround the rod 43 at a distance from the rod 43. An annular space surrounded by the outer surface of the rod 43 and the inner surface of peripheral wall 44 receives one end of the tube 2 attached to the rod 43.

As described above, the connecting member 4 causes the inner space S1 of the container 1 to indirectly be in communication with the passage S2 in the tube 2, receives the chemical solution from the inner space S1, and supplies the chemical solution to the passage S2. The connecting member 4 can control the supply amount of the chemical solution from the container 1 by appropriately adjusting the cross-sectional area of the fine groove S4, and thus stably supplies the chemical solution at a desired flow rate to the passage S2 in the tube 2 further downstream, and consequently to the water storage tank 9.

Also, a support member 45 that supports the container 1 so that it is placed on the lid 92 of the water storage tank 9 is connected to the connection member 4. The support member 45 plays a role of supporting the container 1 so that it is stably installed at a predetermined position. The connection member 4 and the support member 45 may be formed in one piece, or may be formed separately and then joined. In this embodiment, the support member 45 is composed of a plurality of legs hanging down from the lower surface of the base 40. These legs extend vertically and are respectively arranged at four corners of the substantially rectangular base 40. As shown in FIG. 3, these legs constituting the support member 45 are installed so as to stand on the upper surface of the lid 92 of the water storage tank 9, and the container 1 is stably installed on the upper surface of the lid 92.

Although the material constituting the connection member 4 and the support member 45 is not particularly limited, typically, hard resin or metal can be used thereas. For example, the connection member 4 can be preferably made of synthetic resin such as polypropylene, polyethylene, and polyethylene terephthalate. The same applies to the support member 45 as well.

1-2-3. Tube

The tube 2 defines, in its interior, the passage S2 through which the chemical solution flows. As described above, one end of the tube 2 is connected to the rod 43 of the connecting member 4 so as to cover it from the outside. Also, as described above, the passage S2 is in communication with the inner space S1 of the container 1 via the space S3 inside of the piercing portion 41 and the fine groove S4 when one end of the tube 2 and the rod 43 are connected to each other and the container 1 and the piercing portion 41 are connected to each other. Also, as shown in FIG. 3, the intermediate portion of the tube 2 is sandwiched between the tank body 91 and the lid 92, and the other end is accommodated in the water storage tank 9. Accordingly, the passage S2 can guide the chemical solution sent out from the inner space S1 to the inside of the water storage tank 9.

The tube 2 is flexible and can be deformed into various shapes. Accordingly, since the tube 2 can be freely bent, the container 1 and the inside of the water storage tank 9 can be connected to each other via the connection member 4, regardless of where the container 1 is installed. As described above, the chemical solution supply device 100 can easily ensure an installation location and can stably supply the chemical solution from the inside of the container 1 to the inside of the water storage tank 9.

The material constituting the tube 2 is not particularly limited as long as it has flexibility, but typically, rubber, thermoplastic elastomer, or soft resin can be used thereas. For example, the tube 2 can preferably be made of silicone rubber. Note that the contact angle of the chemical solution with respect to the material of the inner surface of the tube 2 is preferably 90° or less. In this case, the chemical solution can flow through the tube 2 at an appropriate speed that is neither too fast nor too slow.

1-2-4. Spacer

As shown in FIG. 3, the spacer 3 is installed so as to be sandwiched between the tank body 91 and the lid 92 of the water storage tank 9, similarly to the tube 2. The spacer 3 has a constant thickness in the vertical direction, and maintains the interval between the tank body 91 and the lid 92. The number of spacers 3 is not particularly limited. One or a plurality of spacers 3 may be arranged only in the vicinity of the tube 2 in the annular upper portion of the tank body 91, or a plurality of spacers 3 may be arranged along the circumferential direction of the annular upper portion of the tank body 91 at predetermined intervals.

In the example of FIG. 3, the spacer 3 has a recess on its lower surface, receives the upper portion of the tank body 91 in the recess, and covers the upper portion of the tank body 91 from above. Accordingly, the spacer 3 is firmly hooked onto the upper portion of the tank body 91 and does not easily fall off of the tank body 91.

The tube 2 is flexible as described above. However, even when the tube 2 is sandwiched between the tank body 91 and the lid 92, since the space in which the tube 2 is arranged is ensured by the spacer 3 between the tank body 91 and the lid 92, the tube 2 is not crushed excessively or is not crushed at all due to the weight of the lid 92. Accordingly, it is possible to prevent a situation in which the passage S2 is blocked and the chemical solution cannot flow through the passage S2. Also, by adjusting the number and arrangement of the spacers 3, it is possible to prevent the lid 92 from rattling with respect to the tank body 91 due to the thickness of the tube 2 sandwiched between the tank body 91 and the lid 92.

The material constituting the spacer 3 is not particularly limited, but typically, hard resin, rubber, or thermoplastic elastomer can be used thereas.

2. Second Embodiment

2-1. Overview of Chemical Solution Supply Device

Figure 5:
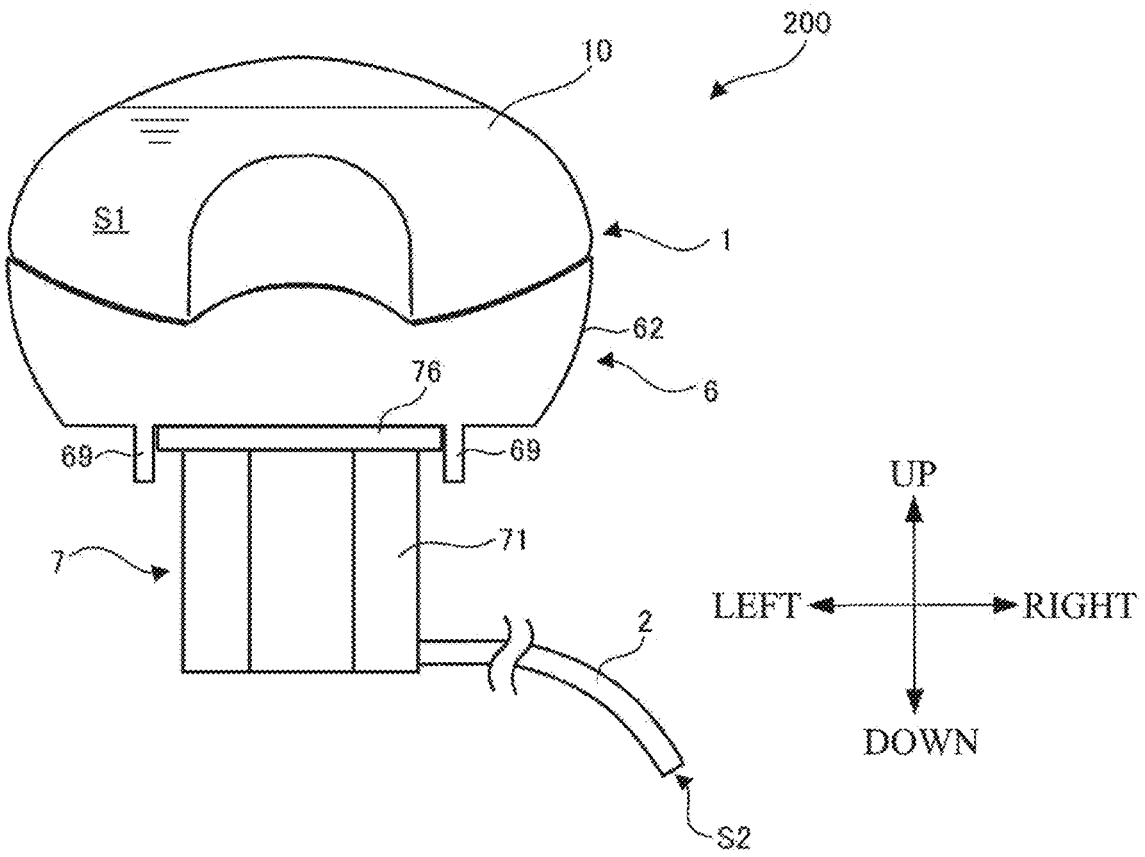
FIG. 5 is a front view of a chemical solution supply device according to a second embodiment of the present invention.
Figure 6:
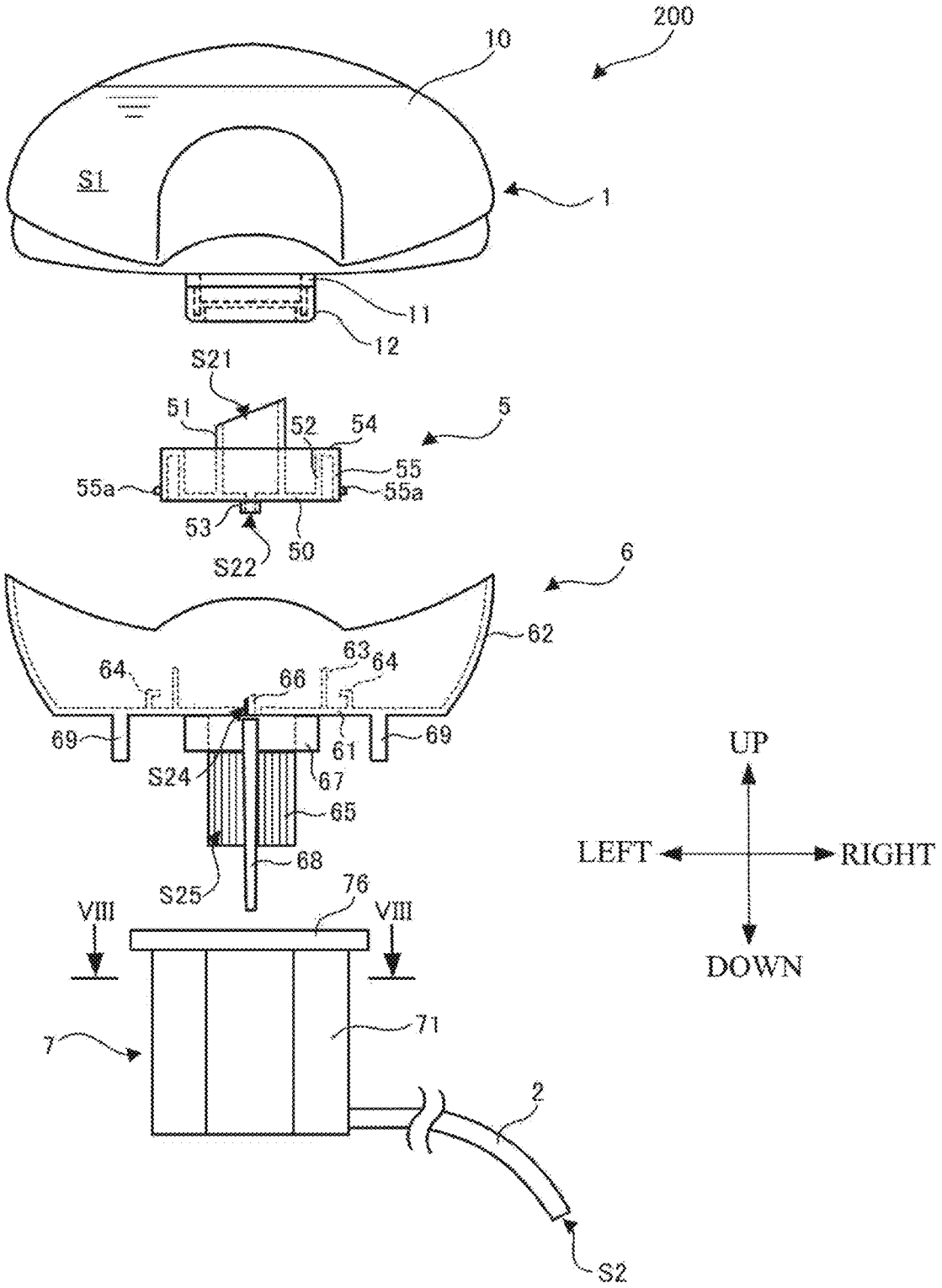
FIG. 6 is an exploded view of the chemical solution supply device according to the second embodiment.
Figure 7:
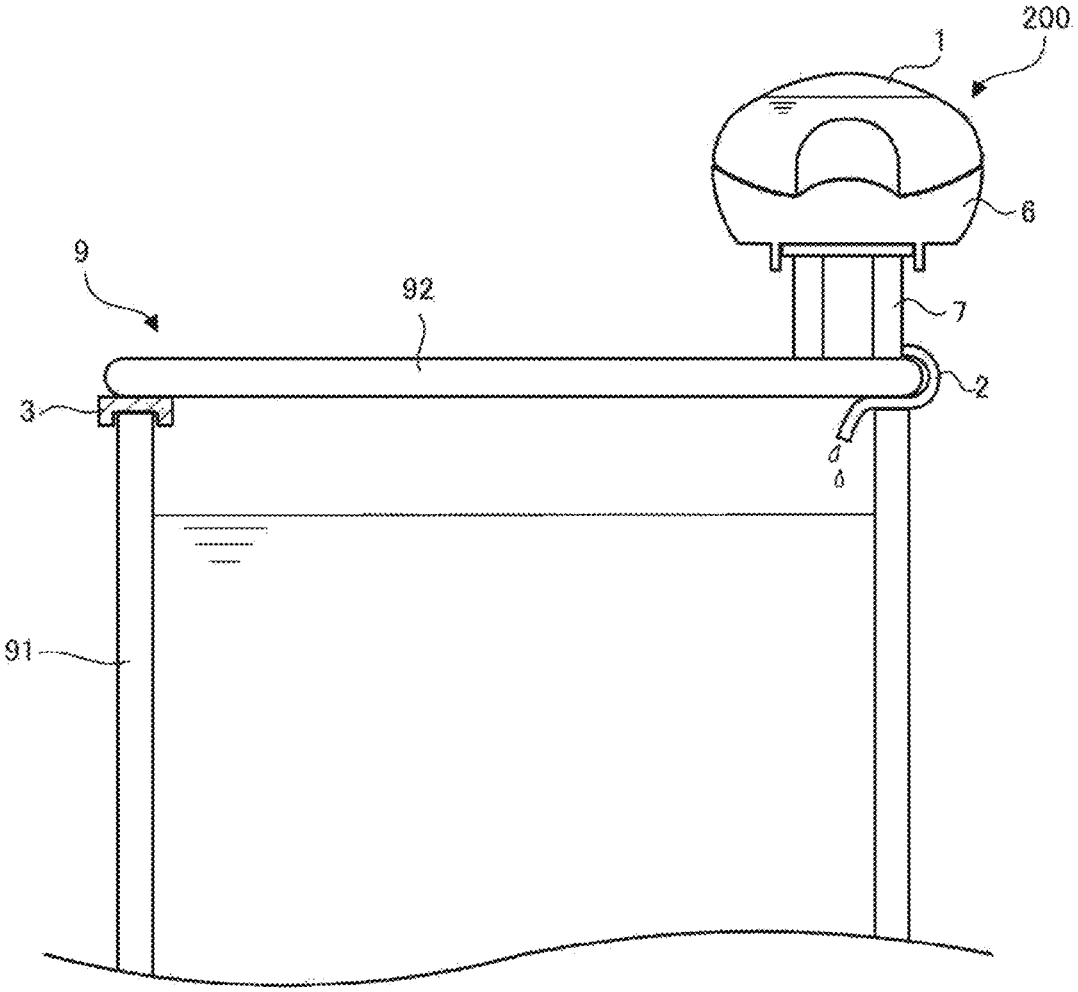
FIG. 7 is a diagram showing an installation example of the chemical solution supply device according to the second embodiment.

FIG. 5 is a front view of a chemical solution supply device 200 according to a second embodiment of the present invention, FIG. 6 is an exploded view thereof, and FIG. 7 is a diagram showing a typical installation example of the chemical solution supply device 200. The chemical solution supply device 200 is also a device that supplies a chemical solution to the toilet bowl of a toilet, similarly to the chemical solution supply device 100. In the following description, elements held in common between the chemical solution supply devices 100 and 200 are denoted by the same reference numerals, and description thereof is omitted as appropriate. In the description here, unless otherwise specified, "upper (top surface)", "lower (bottom surface)", "left", and "right" are defined as shown in FIGS. 5 and 6, "front (front surface)" means the near side in FIGS. 5 and 6, and "rear (rear surface)" means the far side in FIGS. 5 and 6.

As shown in FIGS. 5 to 7, the chemical solution supply device 200 also includes a container 1 in which a chemical solution is accommodated and a tube 2 connected to the container 1, and the chemical solution supply device 200 is installed in the surrounding area of the water storage tank 9 such that the chemical solution can be supplied to the inside of the water storage tank 9. As shown in FIG. 7, the chemical solution supply device 200 is also installed such that the container 1 is arranged on the upper surface of the lid 92 of the water storage tank 9 and the tube 2 is sandwiched between the tank body 91 and the lid 92. The chemical solution supply device 200 also further includes a spacer 3 that is sandwiched between the tank body 91 and the lid 92 in order to prevent the passage S2 in the tube 2 from being blocked. The spacer 3 can also prevent the lid 92 from rattling with respect to the tank body 91 due to the thickness of the tube 2.

On the other hand, the chemical solution supply device 200 further includes a cover member 5, a lower container 6, and a reservoir 7 that are arranged between the container 1 and the tube 2, instead of the connecting member 4. The tube 2 is indirectly connected to the container 1 via these elements 5 to 7. These elements 5 to 7 function as a connecting member that connects the container 1 and the tube 2 as a whole, and play a role of controlling the supply amount of the chemical solution from the container 1, similarly to the connecting member 4.

2-2. Configuration of Each Portion

Details of the cover member 5, the lower container 6, and the reservoir 7 will be described below in order.

2-2-1. Cover Member

As shown in FIG. 6, the cover member 5 has a circular plate-shaped base 50 and a cylindrical piercing portion 51 that stands up from the center of the upper surface of the base 50. Note that, in FIG. 6, for reference, cross sections of the cover member 5 and the lower container 6 taken along a plane that passes through the central axis of the piercing portion 51 and is parallel to the left-right direction are partially indicated by dotted lines. The piercing portion 51 has a shape obtained by obliquely cutting the upper portion of a cylinder extending in the vertical direction, and the upper portion thereof is sharp. The piercing portion 51 is inserted into the outlet portion 11 so as to pierce the bottom surface of the cap 12 of the container 1 from below. The cover member 5 further has a cylindrical peripheral wall portion 52, and the peripheral wall portion 52 is spaced apart from the piercing portion 51 and stands upward from the outer peripheral edge of the base 50 so as to surround the piercing portion 51. An annular space surrounded by the outer surface of the piercing portion 51 and the inner surface of the peripheral wall portion 52 receives the cap 12 and the outlet portion 11 of the container 1.

Also, the cover member 5 further has a cylindrical port member 53 that hangs down from the center of the lower surface of the base 50. A minute opening is formed in the center of the base 50, and the port member 53 is arranged so as to surround the opening. Accordingly, a space S21 inside the piercing portion 51 is in communication with a space S22 inside the port member 53. Note that the port member 53 has a smaller diameter than the piercing portion 51.

The cover member 5 further has an annular top surface portion 54 that is continuous with the upper edge of the peripheral wall portion 52 and extends radially outward from the upper edge. The outer peripheral edge of the top surface portion 54 is rectangular. Moreover, the cover member 5 further has a peripheral wall portion 55 that hangs down from the outer peripheral edge of the top surface portion 54. The peripheral wall portion 55 has a rectangular cylinder shape. A pair of left and right protrusions 55*a* protrude radially outward from the vicinity of the lower portions of the left wall portion and the right wall portion of the peripheral wall portion 55. These protrusions 55*a* connect the lower container 6 and the cover member 5 by hooking onto a pair of left and right claw portions 64 of the lower container 6, which will be described later.

The material constituting the cover member 5 is not particularly limited, but typically, hard resin or metal can be used thereas. For example, the cover member 5 can be preferably made of synthetic resin such as polypropylene, polyethylene, and polyethylene terephthalate.

2-2-2. Lower Container

The lower container 6 is a dish-shaped container that receives the lower portion of the container 1 including the outlet portion 11 and the cap 12 from below. The lower container 6 has a bottom surface portion 61 and an outer wall portion 62 that stands upward and outward from the bottom surface portion 61. Inside the outer wall portion 62, the lower container 6 further has a rectangular cylinder-shaped peripheral wall portion 63 standing up from the upper surface of the bottom portion 61, and the space inside the peripheral wall portion 63 accommodates the cover member 5. At this time, the peripheral wall portion 63 is received in a rectangular annular space surrounded by the outer surface of the peripheral wall portion 52 and the inner surface of the peripheral wall portion 55 of the cover member 5. On the upper surface of the bottom surface portion 61, a pair of left and right claw portions 64 stand up from positions spaced apart from the peripheral wall portion 63 to the left and right. These claws 64 are hooked on the protrusions 55*a* of the cover member 5 described above, and as a result, the lower container 6 is fixed to the cover member 5. Accordingly, the lower container 6 does not accidentally fall off of the cover member 5.

The lower container 6 further has a plate member 65 hanging down from the center of the lower surface of the bottom surface portion 61. The width direction of the plate member 65 extends in the left-right direction, and the thickness direction extends in the front-rear direction. A cylindrical protrusion 66 rises from the center of the upper surface of the plate member 65. An opening is formed in the center of the bottom surface portion 61. The protrusion 66 extends vertically so as to pass through the opening in the center of the bottom surface portion 61. The protrusion 66 has a shape obtained by obliquely cutting the upper portion of a cylinder extending in the vertical direction, and the upper portion is sharp. A large number of fine grooves S25 extending in the vertical direction are formed on the front and rear surfaces of the plate member 65.

The protrusion 66 is inserted into the space S22 inside the port member 53 when the cover member 5 is accommodated in the space inside the peripheral wall portion 63 and the lower container 6 and the cover member 5 are connected to each other. A fine groove S24 extending in the vertical direction is formed on the outer surface of the protrusion 66 over the entire length of the protrusion 66. Accordingly, when the lower container 6 and the cover member 5 are connected to each other, the piercing portion 51 penetrates the cap 12, and the container 1 and the cover member 5 are connected to each other, the fine groove S24 is in communication with the inner space S1 of the container 1. More specifically, the fine groove S24 is in communication with the inner space S1 of the container 1 via the space S21 inside the piercing portion 51, and serves as a passage through which the chemical solution sent out from the inner space S1 flows.

After passing through the fine groove S24, the chemical solution sent out from the inner space S1 reaches the plate member 65 below the protrusion 66 and flows into the fine groove S25 of the plate member 65. At this time, the chemical solution flows from the inner space S1 into the fine groove S24, and further into the fine grooves S25 at a slow speed due to capillary action as well as gravity. After reaching the lower ends of the fine grooves S25 of the plate member 65, the chemical solution drops from the plate member 65 and is accommodated in the reservoir 7. The fine grooves S25 also serve as passages through which the chemical solution sent out from the inner space S1 flows.

The lower container 6 further has a rectangular cylinder-shaped peripheral wall portion 67, and the peripheral wall portion 67 is spaced apart from the plate member 65 and hangs down from the lower surface of the bottom surface portion 61 so as to surround the plate member 65. A pair of front and rear rods 68 extending in the vertical direction are arranged at the center of the front surface and the center of the rear surface of the peripheral wall portion 67. Although the details will be described later, the pair of front and rear rods 68 are used for positioning the lower container 6 with respect to the reservoir 7.

Also, the lower container 6 further has a support portion 69 extending downward from the outer wall portion 62. In this embodiment, the support portion 69 is constituted by a plurality of legs. These legs extend in the vertical direction, and two of these legs are arranged in the lower portion of the front surface of the outer wall portion 62 at a certain interval in the left-right direction, and two of them are further arranged at the lower portion of the rear surface of the outer wall portion 62 at a certain interval in the left-right direction.

Although the details will be described later, in this embodiment, the reservoir 7 is arranged below the lower container 6, and the container 1 is placed on the lid 92 of the water storage tank 9 via the reservoir 7. However, if the cover 92 has a water supply receiving tray for hand washing, the container 1 can also be installed on the water supply receiving tray using only the cover member 5 and the lower container 6, without using the reservoir 7. At this time, the pair of front and rear rods 68 are inserted together with the plate member 65 into an opening formed in the water supply receiving tray through which the washing water flows into the water storage tank 9. Also, at this time, the plurality of legs constituting the support portion 69 are installed so as to stand upright on the water supply receiving tray. The support portion 69 supports the container 1 so that the container 1 is stably installed in the water supply receiving tray.

Although the material constituting the lower container 6 is not particularly limited, typically, hard resin or metal can be used thereas. For example, the lower container 6 can be preferably made of synthetic resin such as polypropylene, polyethylene, and polyethylene terephthalate.

2-2-3. Reservoir

The reservoir 7 has a box shape with an opening at its upper portion, and has a storage space S26 in which the chemical solution is stored. The reservoir 7 is arranged below the lower container 6, receives the chemical solution from the inner space S1 of the container 1 via the cover member 5 and the lower container 6, and temporarily stores the chemical solution in the storage space S26.

Figure 8:
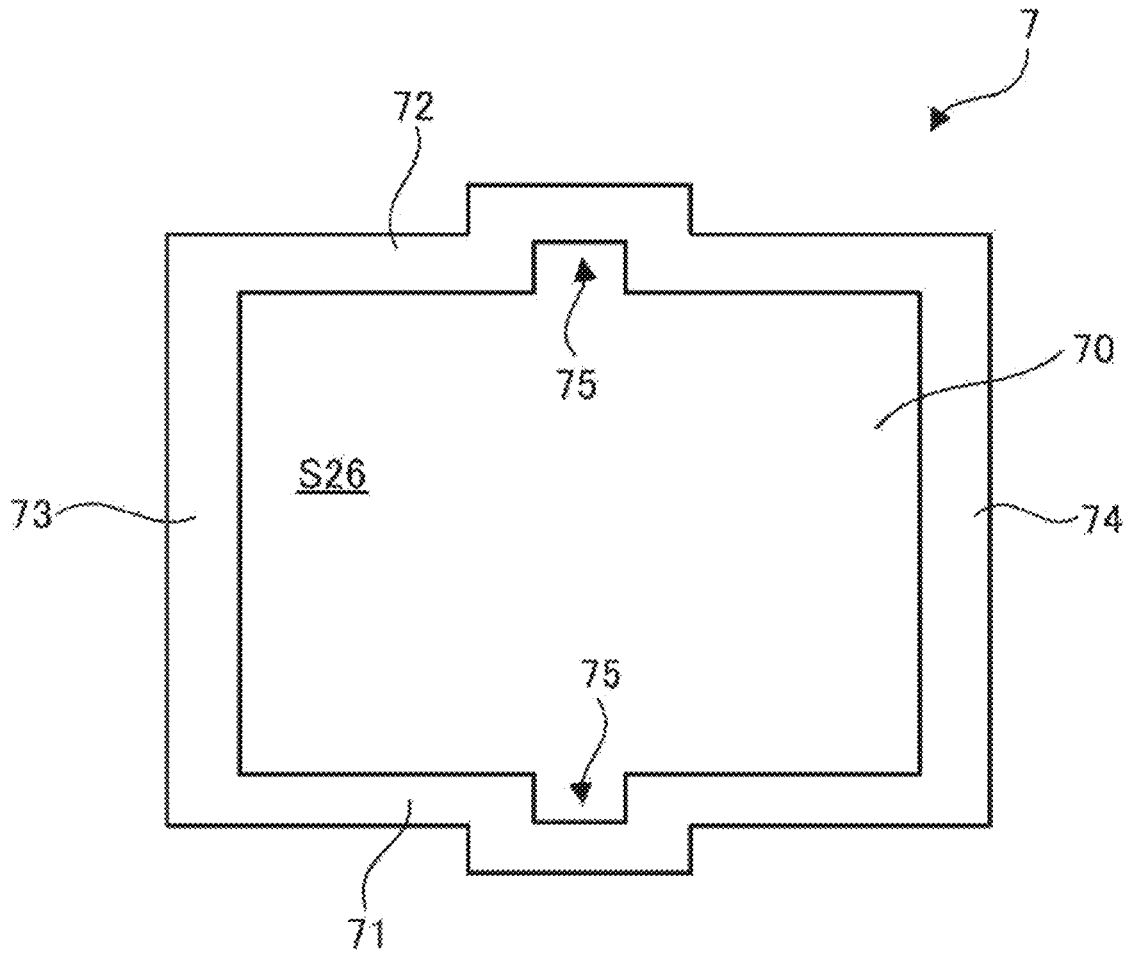
FIG. 8 is a cross-sectional view taken along line VIII-VIII of FIG. 6.

FIG. 8 is a cross-sectional view taken along line VIII-VIII of FIG. 6. The reservoir 7 includes a rectangular bottom surface portion 70, and a front wall portion 71, a rear wall portion 72, a left wall portion 73, and a right wall portion 74 that stand up from the front edge, rear edge, left edge, and right edge of the bottom portion 70, respectively. Also, the reservoir 7 further has an angular loop-shaped flange 76 that is continuous with the upper edges of the walls 71 to 74.

A pair of front and rear recesses 75 extending in the vertical direction are formed in the center in the left-right direction of the inner surfaces of the front wall portion 71 and the rear wall portion 72. The pair of front and rear rods 68 of the lower container 6 are inserted into these recesses 75, whereby the lower container 6 is positioned with respect to and connected to the reservoir 7. At this time, the bottom surface portion 61 of the lower container 6 is placed on the upper surface of the flange 76. Note that at this time, the plurality of legs constituting the support portion 69 are arranged at positions that do not interfere with the flange 76, as shown in FIG. 5.

An outlet is formed in the vicinity of the bottom surface portion 70 in the right wall portion 74 of the reservoir 7, and the tube 2 is inserted into the outlet. The tube 2 is fixed to the reservoir 7 by fixing means (not shown). As described above, the tube 2 is connected to the reservoir 7 such that the passage S2 in its interior is in communication with the storage space S26.

When the reservoir 7 and the lower container 6 are connected to each other, the plate member 65 and the peripheral wall portion 67 of the lower container 6 are received in the storage space S26. As described above, the chemical solution is sent from the inner space S1 of the container 1, follows various routes, and reaches the fine grooves S25 of the plate member 65 of the lower container 6. Thereafter, the chemical solution flows downward along the fine grooves S25 and drops into the reservoir 7 from the fine grooves S25. The reservoir 7 supplies the chemical solution thus stored in the storage space S26 to the passage S2 in the tube 2 via the outlet of the right wall portion 74. Thereafter, the chemical solution passes through the passage S2 and is ultimately guided into the water storage tank 9.

The material constituting the reservoir 7 is not particularly limited, but typically, hard resin or metal can be used thereas. For example, the reservoir 7 can be preferably made of synthetic resin such as polypropylene, polyethylene, and polyethylene terephthalate.

As described above, the cover member 5, the lower container 6, and the reservoir 7 allow the inner space S1 of the container 1 to indirectly be in communication with the passage S2 in the tube 2. These elements 5 to 7 receive the chemical solution from the interior space S1 and supply the chemical solution to the passage S2. These elements 5 to 7 can control the supply amount of the chemical solution from the container 1 by appropriately adjusting the cross-sectional areas of the fine grooves S24 and S25 through which the chemical solution passes, and thus stably supply the chemical solution with a desired flow rate to the passage S2 further downstream, and consequently, into the water storage tank 9. Since the chemical solution supply device 200 also has the tube 2, which is flexible, it is easy to ensure an installation location, similarly to the chemical solution supply device 100.

3. Modified Examples

Although several embodiments of the present invention have been described above, the present invention is not limited to the above embodiments, and various modifications are possible without departing from the gist of the present invention. For example, the following modifications are possible. Also, the gists of the following modified examples can be combined as appropriate.

<3-1>

In the above embodiment, the container 1 was installed on the lid 92 of the water storage tank 9, and the tube 2 was installed so as to be sandwiched between the tank body 91 and the lid 92. However, the mode of installation of the chemical solution supply devices 100 and 200 is not limited to this example, and the chemical solution supply devices 100 and 200 can be installed in various locations.

Figure 9:
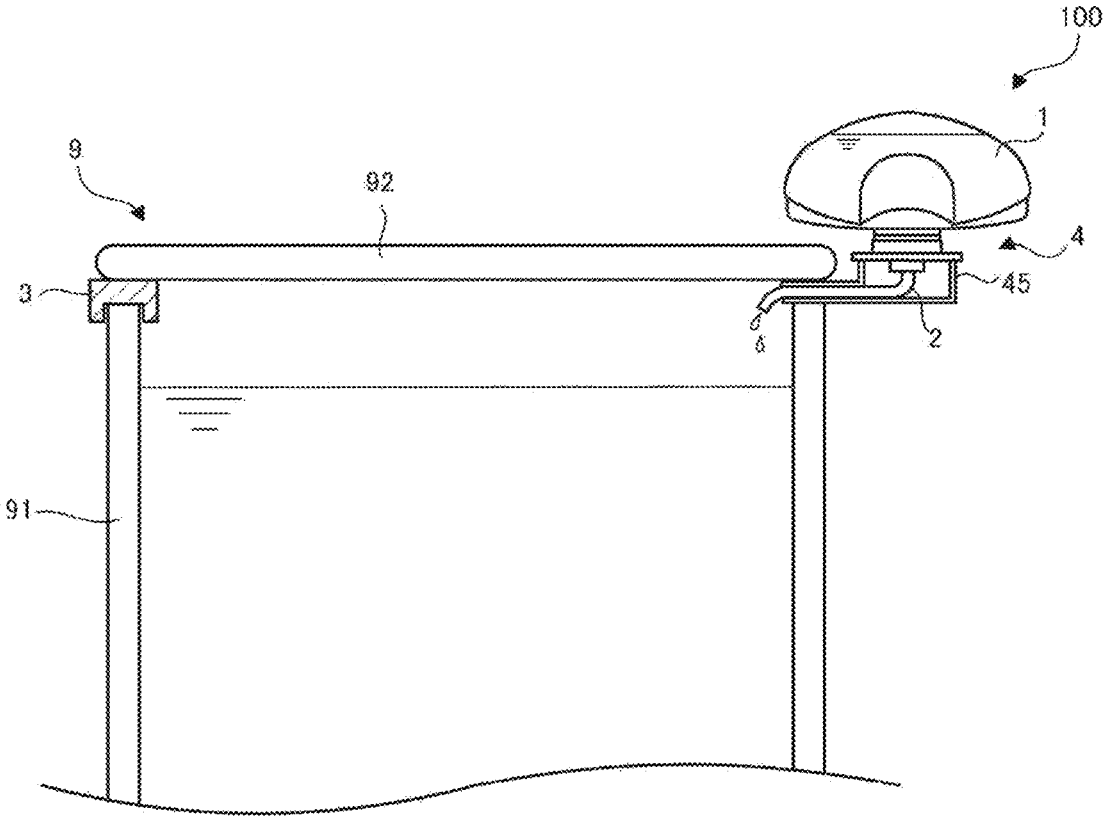
FIG. 9 is a diagram showing an installation example of a chemical solution supply device according to a modified example.

For example, as shown in FIG. 9, the container 1 may also be installed on the side of the water storage tank 9. In this case, it is preferable to appropriately modify the support member 45 to a shape capable of supporting the container 1 so as to be installed on the side of the water storage tank 9.

Figure 10:
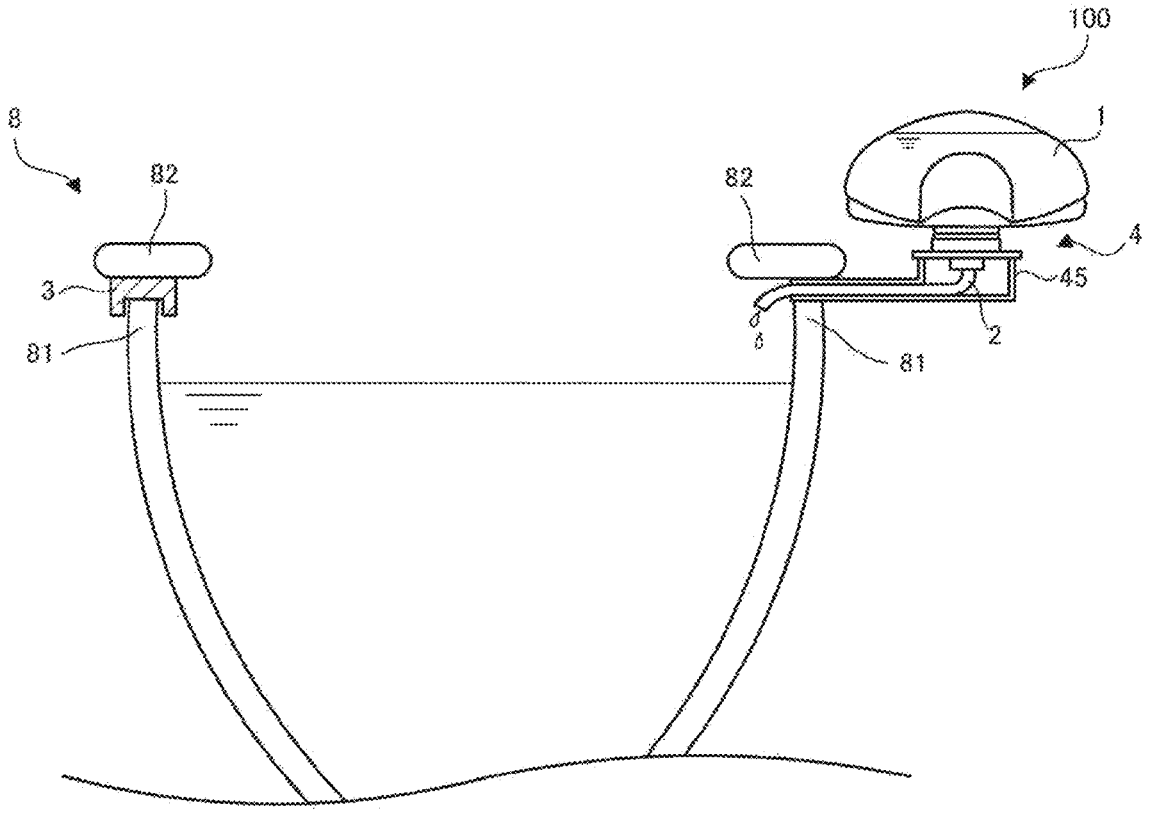
FIG. 10 is a diagram showing an installation example of a chemical solution supply device according to another modified example.

Also, for example, as shown in FIG. 10, the container 1 may be installed on the side of the toilet bowl 8, and one end of the tube 2 may be accommodated in the toilet bowl 8. In this case, the passage S2 in the tube 2 can guide the chemical solution directly into the toilet bowl 8 without going through the water storage tank 9. Also, in this case, it is preferable to appropriately modify the support member 45 into a shape capable of supporting the container 1 so as to be installed on the side of the toilet bowl 8. Also, in this case, the tube 2 can be installed so as to be sandwiched between the rim 81 of the toilet bowl 8 and the toilet seat 82 attached to the toilet bowl 8. Also, in this case, similarly to the tube 2, the spacer 3 is preferably installed so as to be sandwiched between the rim 81 of the toilet bowl 8 and the toilet seat 82.

Note that FIGS. 9 and 10 show a modified example of the chemical solution supply device 100, but the chemical solution supply device 200 can also be modified so that the container 1 can be installed on the side of the water storage tank 9 or the side of the toilet bowl 8. In this case, it is sufficient to also provide the chemical solution supply device 200 with a support member that performs the same function as the support member 45.

<3-2>

In the above embodiment, the spacer 3 can be omitted. In this case, the portion of the tube 2 that is sandwiched between the tank body 91 and the lid 92 (or between the rim 81 of the toilet bowl 8 and the toilet seat 82) may be partially rigid so as not to be crushed.

Figure 11:
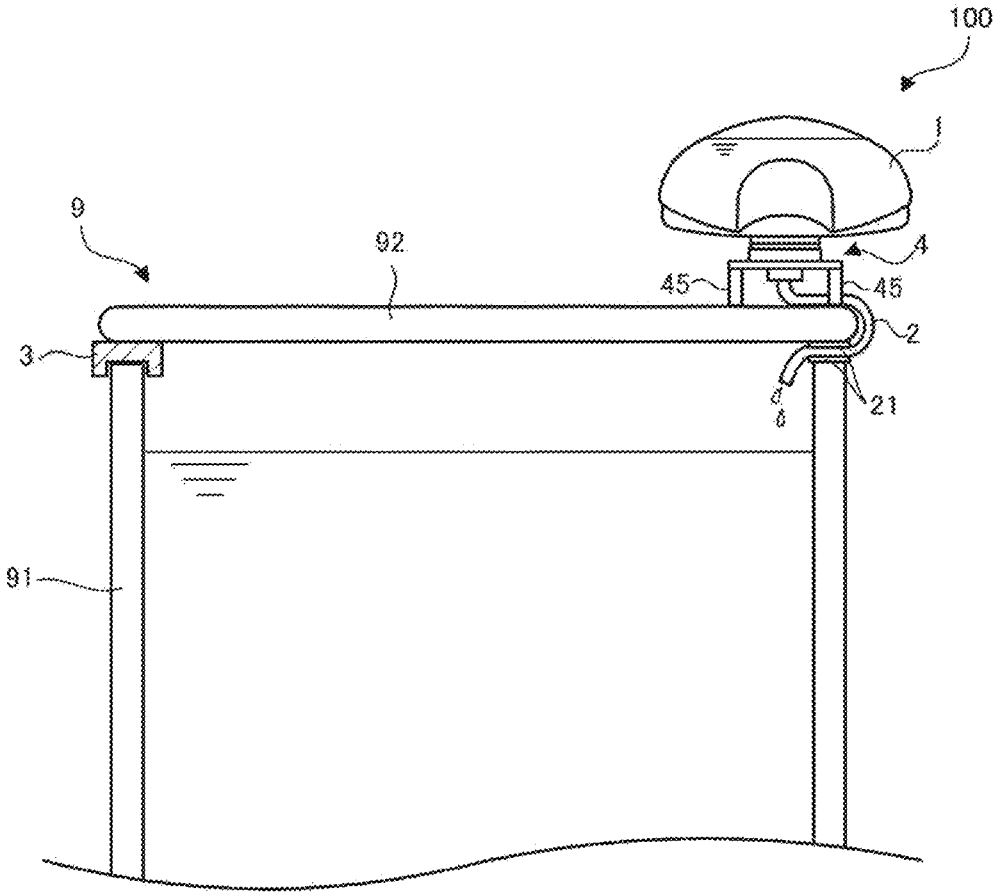
FIG. 11 is a diagram showing an installation example of a chemical solution supply device according to a further modified example.

Alternatively, as shown in FIG. 11, a rigid guard member 21 may be attached to the portion of the tube 2 that is sandwiched between the tank body 91 and the lid 92 (or between the rim 81 of the toilet bowl 8 and the toilet seat 82) so that the portion is not crushed. For example, the guard member 21 can be made of a hard material such as hard resin, and can be realized as a tubular member into which the tube 2 is inserted. In this case, the guard member 21 is preferably slidable along the lengthwise direction of tube 2.

<3-3>

In the first embodiment, the connecting member 4 may be omitted and the tube 2 may be directly connected to the outlet portion 11 of the container 1. Similarly, in the second embodiment as well, the cover member 5, the lower container 6, and the reservoir 7 may be omitted, and the tube 2 may be directly connected to the outlet portion 11 of the container 1.

LIST OF REFERENCE NUMERALS

100 Chemical solution supply device
1 Container
2 Tube
21 Guard member
3 Spacer
4 Connecting member
45 Support member
7 Reservoir
S1 Inner space
S2 Passage
S26 Storage space
8 Toilet bowl
81 Rim
82 Toilet seat
9 Water storage tank
91 Tank body
92 Lid

The invention claimed is:

1. A chemical solution supply device comprising:

a container having an inner space in which a chemical solution to be supplied to a toilet bowl is accommodated; and a flexible tube that is in communication with the inner space and defines a passage for guiding the chemical solution sent out from the inner space to the inside of the toilet bowl, or to the inside of a water tank for supplying washing water to the inside of the toilet bowl; and a connecting member that allows the inner space and the passage to indirectly be in communication with each other by being connected to the container and the flexible tube, receiving the chemical solution from the inner space, and supplying the chemical solution to the passage, wherein the connecting member includes:

a base; and a cylindrical piercing portion standing up from a center of an upper surface of the base.

2. The chemical solution supply device according to claim 1, wherein the tube is installed so as to be sandwiched between a first element and a second element, and the first element is a tank body included in the water storage tank and the second element is a lid of the tank body included in the water storage tank, or the first element is a rim of the toilet bowl and the second element is a toilet seat attached to the toilet bowl.

3. The chemical solution supply device according to claim 2, further comprising a spacer that is installed so as to be sandwiched between the first element and the second element to prevent blockage of the passage.

4. The chemical solution supply device according to claim 3, wherein the tube is partially rigid at a portion to be sandwiched between the first element and the second element, or the chemical solution supply device further comprises a rigid guard portion that is attached to the portion of the tube that is to be sandwiched between the first element and the second element.

5. The chemical solution supply device according to claim 3, further comprising a support member for supporting the container such that the container is installed on a lid of a tank body included in the water storage tank, on a side of the water storage tank, or on a side of the toilet bowl.

6. The chemical solution supply device according to claim 2, wherein the tube is partially rigid at a portion to be sandwiched between the first element and the second element, or the chemical solution supply device further comprises a rigid guard portion that is attached to the portion of the tube that is to be sandwiched between the first element and the second element.

7. The chemical solution supply device according to claim 6, further comprising a support member for supporting the container such that the container is installed on a lid of a tank body included in the water storage tank, on a side of the water storage tank, or on a side of the toilet bowl.

8. The chemical solution supply device according to claim 2, further comprising a support member for supporting the container such that the container is installed on a lid of a tank body included in the water storage tank, on a side of the water storage tank, or on a side of the toilet bowl.

9. The chemical solution supply device according to claim 1, wherein the connecting member has a reservoir having a storage space for storing the chemical solution received from the inner space, and the tube is connected to the reservoir such that the passage is in communication with the storage space, and the reservoir supplies the chemical solution stored in the storage space to the passage.

10. The chemical solution supply device according to claim 9, further comprising a support member for supporting the container such that the container is installed on a lid of a tank body included in the water storage tank, on a side of the water storage tank, or on a side of the toilet bowl.

11. The chemical solution supply device according to claim 1, further comprising a support member for supporting the container such that the container is installed on a lid of a tank body included in the water storage tank, on a side of the water storage tank, or on a side of the toilet bowl.

12. A chemical solution supply device comprising:

a container having an inner space in which a chemical solution to be supplied to a toilet bowl is accommodated;

a flexible tube that is in communication with the inner space and defines a passage for guiding the chemical solution sent out from the inner space to the inside of the toilet bowl, or to the inside of a water tank for supplying washing water to the inside of the toilet bowl; and a connecting member that allows the inner space and the passage to indirectly be in communication with each other by receiving the chemical solution from the inner space, and supplying the chemical solution to the passage, wherein the connecting member includes:

a cover member that is connected to the container; and a lower container that accommodates the cover member, wherein the cover member includes:

a base; and a piercing portion standing up from an upper surface of the base toward the container, and wherein the lower container is connected to the tube or is connected to the tube via another element.

* * * * *